United States Patent [19]

Matsumoto et al.

[11] Patent Number: 4,771,676

[45] Date of Patent: Sep. 20, 1988

[54] HYDRAULIC TRANSMISSION DEVICE

[75] Inventors: Satoshi Matsumoto; Kohji Sato, both of Zama, Japan

[73] Assignee: Toshiba Kikai Kabushiki Kaisha, Tokyo, Japan

[21] Appl. No.: 49,516

[22] Filed: May 14, 1987

[30] Foreign Application Priority Data

May 19, 1986 [JP] Japan ..... 61-75103[U]
Jul. 3, 1986 [JP] Japan ..... 61-102382[U]
Apr. 1, 1987 [JP] Japan ..... 62-49795[U]

[51] Int. Cl.[4] ..... F01B 13/04; F01B 3/00; F01B 13; F01B 04

[52] U.S. Cl. ..... 92/57; 92/12.2; 92/71; 92/47; 91/499; 91/507; 91/485; 91/484; 417/269

[58] Field of Search ..... 92/12.2, 57, 71, 47; 91/499, 507, 485, 486, 484; 417/269

[56] References Cited

U.S. PATENT DOCUMENTS

| | | | |
|---|---|---|---|
| 2,168,658 | 8/1939 | Thomas | 91/499 |
| 3,246,575 | 4/1966 | Raymond | 91/507 |
| 3,604,314 | 9/1971 | Steiner | 91/485 |
| 3,657,970 | 4/1972 | Kobayashi | 91/485 |
| 4,602,554 | 7/1986 | Wagenseil et al. | 91/486 |

FOREIGN PATENT DOCUMENTS

| | | | |
|---|---|---|---|
| 393923 | 11/1965 | Fed. Rep. of Germany | 91/507 |
| 646739 | 10/1962 | Italy | 91/499 |
| 955696 | 4/1964 | United Kingdom | 91/499 |

*Primary Examiner*—Robert E. Garrett
*Assistant Examiner*—Thomas Denion
*Attorney, Agent, or Firm*—Stevens, Davis, Miller & Mosher

[57] ABSTRACT

A hydraulic transmission device operable to translate hydraulic energy into mechanical energy and vice versa. The device has a housing 14 having a close end portion and an open end portion in the longitudinal direction. The housing supports therein a drive shaft 11, a retainer 12, and a cylinder block 13 which have an integral structure. A recess is formed at a substantially central location of the end surface of the cylinder block 13 that is on the side of an open end of the housing, and a cover 15 closing the open end of the housing has a protruding portion 15A which extends through a port plate 23 to be engaged with the recess of the cylinder block through a bearing 17. A plurality of pistons are disposed in the cylinder block and are kept in tight engagement with a swash plate fixed to the closed end portion of the housing at a constant tilt angle. The device acts as either a swash plate type axial piston pump or motor of this type as the drive shaft rotates.

3 Claims, 2 Drawing Sheets

HYDRAULIC TRANSMISSION DEVICE

BACKGROUND OF THE INVENTION

The present invention relates to a hydraulic transmission device capable of acting as either a hydraulic pump which converts mechanical energy to hydraulic energy or as a hydraulic motor which receives hydraulic energy and converts it to mechanical energy, and more particularly to a swash plate type axial piston pump-motor having a swash plate provided at a tilt angle.

A swash plate type axial piston pump-motor has conventionally been known as a hydraulic transmission device which can be used in converting received mechanical energy to hydraulic energy or, conversely, in obtaining mechanical energy from hydraulic energy. There are two types of swash plate, axial piston pump-motors; one is a constant displacement type axial piston pump-motor which has a swash plate provided at a constant tilt angle, and the other is a variable displacement type axial piston pump-motor which enables the tilt angle of the swash plate to be varied. There is no particular difference in energy conversion principle between these types.

FIG. 1 shows an example of a conventional variable displacement type of axial piston pump-motor, that disclosed in Japanese Patent Publication No. 39569/1970. In this example, one end of a housing 14 (i.e., the left end as viewed in the drawing) is closed and has in a substantially central location a through hole for inserting a drive shaft, while the other end of the housing 14 (i.e., the right end as viewed in the drawing) is open. The drive shaft 11 is connected to a power source such as a motor (not shown), is inserted into the through hole, and is journaled at one end in the housing 14 by means of a bearing 16. A cylinder block 13 is splined on the drive shaft 11 and is provided with a plurality of cylinders 18A which are angularly spaced around the longitudinal axis of rotation of the drive shaft and are disposed parallel to the axis. A plurality of pistons 18 are each received in a corresponding cylinder 18A so as to reciprocate therein, and each has an end (i.e., the left end as viewed in the drawing) formed as a spherical head which rotatably engages with a corresponding shoe 19 that is kept in substantially continuous contact with the planar surface of a tiltable swash or cam plate 20 as the cylinder block 13 rotates.

One end of the cylinder block 13 (i.e., the left end as viewed in the drawing) is in engagement with a retainer 12 which has a spherical outer surface and is provided on the shaft 11, so as to support the swash plate 20 through the shoes 19 and a return plate 22. The tilt angle of the swash plate 20 can be varied by means of an actuator incorporated in the housing.

The end portion of the housing 14 at its open end is closed by a rear cover 15 over a port plate (valve plate) 23, and the other end of the cylinder block 13 can slide on the port plate 23. Substantially central locations of the port plate 23 and the rear cover 15 have coaxial holes into which the other end 11A of the drive shaft 11 is inserted so as to be supported by the rear cover 15. The cylinder block 13 which is splined on the drive shaft 11 is supported in this way in the housing 14. The port plate 23 and the rear cover 15 are provided with a plurality of intake and discharge ports 27 and 26 communicating with the corresponding cylinders 18A, so that the device can act as an axial piston pump by sucking in and discharging operating fluid from and to the exterior when the drive shaft 11 is rotated by the operation of a drive source, causing the rotation of the cylinder block 13 and reciprocal movement of the pistons 18; or, conversely, as an axial piston motor when the suction and discharge of operating fluid causes the rotation of the drive shaft.

However, with the conventional swash plate type axial piston pump-motor having the above-described arrangement, the cylinder block 13, the drive shaft 11, and the retainer 12 are respectively composed of separate component parts, and the retainer 12 is urged by springs 30 provided within the cylinder block 13 toward the annular, shoe-contacting return plate 22. Consequently, the overall structure of the device is complicated and its production costs are therefore high. In addition, since the cylinder block 13 and the drive shaft 11 are composed of individual component parts, small gaps may occur between these members during assembly, causing relative movement thereof and, hence, noise when there is a variation in the load.

In view of these circumstances, various proposals have been made, including a proposal for an arrangement in which the cylinder block, the drive shaft, and retainer are designed to have an integral structure, in an attempt to solve the above-described problems. With this proposal, however, the end surface of the cylinder block 13 (the right end surface as viewed in FIG. 1) that is away from the drive shaft end journaled by the bearing and is in sliding contact with the port plate 23 is supported in the housing 14 by making the rear end portion 11A of the drive shaft 11 project through that end surface of the cylinder block 13 into the rear cover 15. Thus, this support of the right end surface of the cylinder block 13 necessitates the rearwardly projecting end portion 11A of the drive shaft 11. However, the projecting shaft portion represents an obstacle to the machining of the rear end surface of the cylinder block 13 and makes it difficult to work the rear end surface with a very high degree of precision. Consequently, it is nearly impossible to limit the amount of leakage between the end surface of the cylinder block 13 and the port plate 23 to a small amount. Thus, the prior art has not been able to achieve a highly efficient pump-motor.

SUMMARY OF THE INVENTION

An object of the present invention is to obviate the above-described problems of the prior art and to provide a hydraulic transmission device which is capable of limiting the amount of leakage to a very small amount and is thus efficient.

Another object of the present invention is to provide a hydraulic transmission device in which the drive shaft, the retainer, and the cylinder block have an integral structure and in which the drive shaft does not project rearward through the rear end surface of the cylinder block beyond the port plate, so that the device is compact and is highly accurate.

A further object of the present invention is to provide a swash plate type axial piston pump-motor which is improved so as to achieve a reduction in the total number of component parts and a reduction in the causes of noise.

In order to achieve the above and other objects, the present invention provides a hydraulic transmission device operable to translate hydraulic energy into mechanical energy and vice versa, the device being characterized in that: a drive shaft, a retainer, and a cylinder block which are all provided in a housing of the device have an integral structure; a recess is formed at a substantially central location of the end surface of the cylinder block that is on the side of an open end of the housing; and a cover closing the open end of the housing has a protruding portion which extends through a port plate to be engaged with the recess of the cylinder block through a bearing.

DESCRIPTION OF THE PREFERRED EMBODIMENTS

The present invention will now be described in detail with reference to the accompanying drawings.

Figure 1:
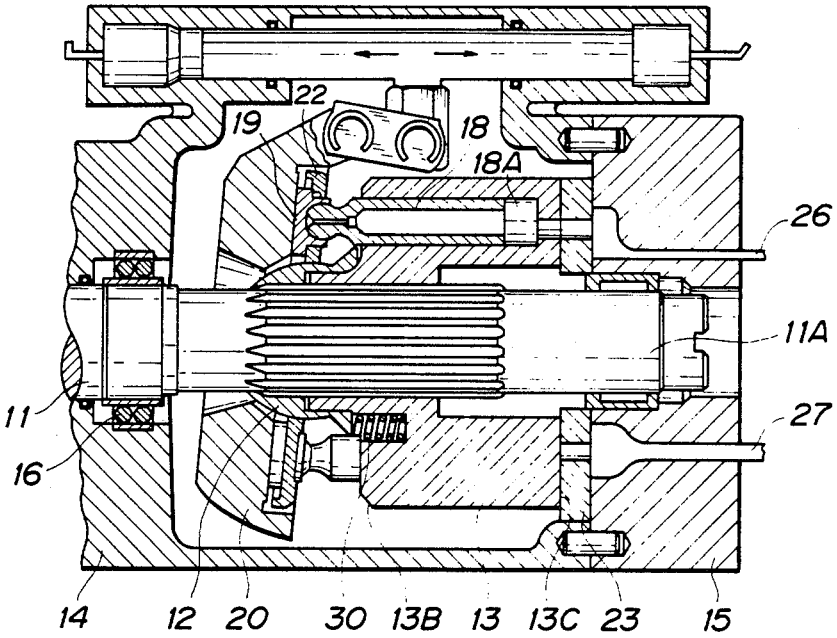
FIG. 1 PRIOR ART
FIG. 1 is a longitudinal sectional view through a conventional swash plate type axial piston pump-motor.
Figure 2:
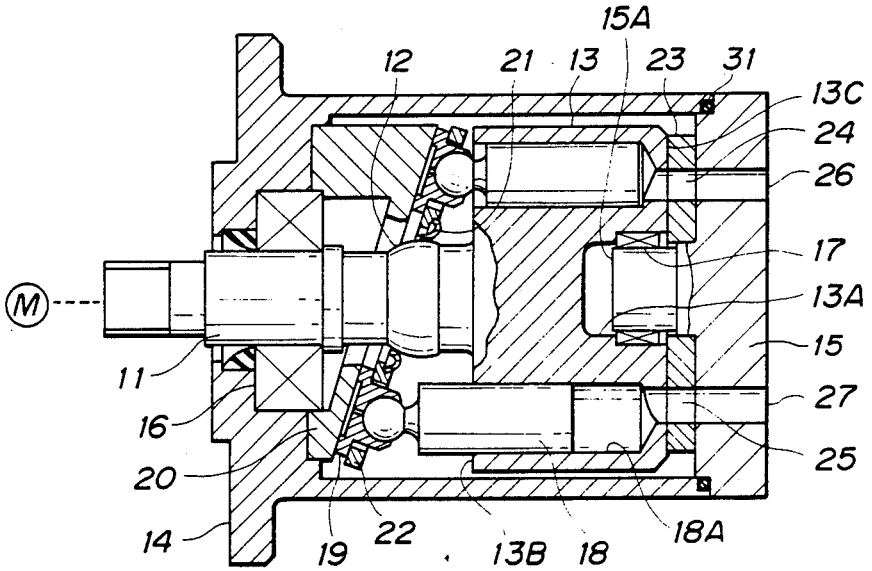
FIG. 2 is a longitudinal sectional view through a swash plate type axial piston pump-motor according to a first embodiment of the present invention.

FIG. 2 is a longitudinal sectional view through a swash plate type axial piston pump-motor as a hydraulic transmission device according to a first embodiment of the present invention. The pump-motor of this embodiment is of the fixed tilt angle swash plate type. Component parts or elements designated by the same reference numbers as those in FIG. 1 will be described only briefly.

In FIG. 2, a housing 14 has a closed end portion and an open end portion on the left and right side, respectively, as viewed in the drawing. A substantially central location of the closed end portion of the housing 14 has a through hole, and a drive shaft 11 connected to a drive source such as a motor M is inserted into this through hole so as to be rotatably supported by the housing 14 through a bearing 16. The open end portion of the housing 14 is closed by a rear cover 15 which is provided with fluid suction and discharge ports, described later.

In this embodiment of the present invention, the drive shaft 11, a retainer 12 which is provided on the drive shaft 11 and which has a spherical outer surface, and a cylinder block 13 are integrally formed by, for instance, by a known casting or forging method. A plurality of cylinders 18A are provided in the cylinder block 13 and enable the reciprocal movement of a corresponding plurality of pistons 18 received therein. A spherical head at the end of each piston is rotatably engaged with a corresponding shoe 19 which is in contact with a swash plate 20 fixed to the closed end portion of the housing 14 at a constant tilt angle in such a manner as to enable the rocking movement of the swash plate 20. More specifically, the shoes 19 are kept in close contact with the swash plate 20 by being urged by the retainer 12 through springs 21 made of a material such as steel and a return plate 22.

The open end of the housing 14 is sealed by the rear cover 15, and the cover 15 is in close contact with the rear end portion of the cylinder block 13 over a port plate 23. The rear end portion of the cylinder block 13 has a recess 13A formed in a substantially central location of the rear end surface thereof. A protruding portion 15A of the rear cover 15, which is formed integrally therewith, is inserted into this recess of the cylinder block 13, so as to rotatably support the cylinder block 13 through a bearing 17.

The port plate 23 is provided with crescent-shaped holes 24 and 25 for fluid discharge and suction, respectively, communicating with the plurality of cylinders 18A provided in the cylinder block 13. These holes 24 and 25 extend through the cover 15 and their cross-sections converge into circular cross-sections of discharge and suction ports 26 and 27 which are connected to the external mechanism.

The device according to the first embodiment has the above-described arrangement. The operation of the device will now be described on the assumption that the device is being used as a pump.

When the drive shaft 11 is driven by the drive source M, the drive shaft 11 rotates and the retainer 12 and the cylinder block 13, which are integral with the shaft 11, also rotate within the housing 14. This rotation is converted into leftward and rightward reciprocal movements of the pistons 18 since the pistons 18 are operationally linked to the swash plate 20 through the retainer 12, the elastic member 21, the return plate 22, and the shoes 19. As a result, in the illustrated embodiment, when each piston 18 moves leftward, the piston sucks fluid from the suction port 27 of the rear cover 15 and the hole 25 of the port plate 23 into the cylinder 18A; and conversely, when each piston 18 moves rightward, the piston 18 discharges fluid to the exterior through the hole 24 of the port plate 23 and the discharge port 26 of the rear cover 15. In this way, the device acts as a hydraulic axial piston pump by converting mechanical energy generated by the motor M to hydraulic energy.

The device can also be made to act as a hydraulic axial piston motor by reversing the above-described hydraulic transmission operation, that is, by causing the reciprocal movement of the pistons by supplying fluid to the pistons, to rotate the drive shaft through the rotation of the cylinder block.

Figure 3:
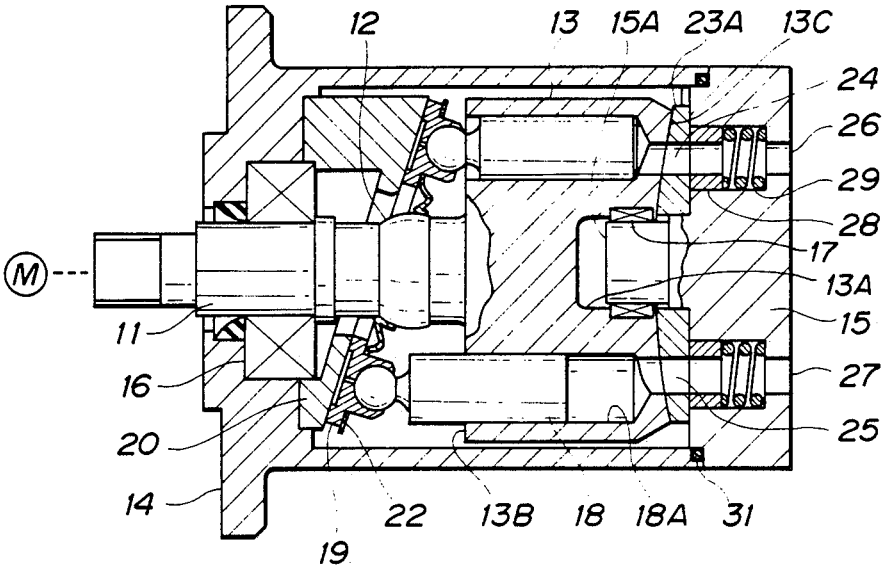
FIG. 3 is a longitudinal sectional view through a swash plate type axial piston pump-motor according to a second embodiment of the present invention.

FIG. 3 shows a second embodiment of the present invention. This embodiment differs in arrangement from the first embodiment shown in FIG. 2 in that each of the surfaces of the cylinder block 13 and the port plate 23A at which these members are kept in contact with each other is made into a spherical surface. As shown in the drawing, the port plate 23A has a spherical surface convexed toward the drive shaft 11, while the rear end surface 13C of the cylinder block 13 which is in contact with that surface of the port plate 23A is formed as a concaved spherical surface matching the convex spherical surface of the port plate 23A. By virtue of this arrangement, even if the rear end surface 13C of the cylinder block 13 tends to be displaced on being subjected to a force which is perpendicular to the axis of rotation, the engagement between the cylinder block 13 and the port plate 23A is not adversely affected. Needless to say, a similar effect can be obtained from an arrangement in which the port plate 23A and the rear end surface 13C of the cylinder block 13 are in mutual contact at spherical surfaces each curved in the opposite direction.

A second feature of the embodiment shown in FIG. 3 is that the suction and discharge ports 27 and 26 provided in the rear cover 15 are each formed as a stepped hole, and a spring member 29 is inserted between the port plate 23A and a stepped shoulder so as to urge a bush 28 toward the port plate 23A and thereby to urge the port plate 23A toward the rear end surface of the cylinder block 13, thus enhancing the engagement between these two members. In particular, when the fluid supply pressure is low, this urging force acts to prevent any drop in fluid-tightness. Needless to say, this technique of forming stepped holes and inserting bushes and springs may also be applied to the embodiment shown in FIG. 2.

The tight sealing effect may be further enhanced by providing a member such as an O-ring 31 at the engagement portion between the rear cover 15 and the housing 14.

In the previous embodiment, spring members 21 are interposed between the return plate 22 and the retainer 12 so as to keep the shoes 19 in contact with the swash plate 20. However, an increase in the number of component parts may result in a complicated structure and an increase in the causes of noise between members. Therefore, as shown in FIG. 3, the arrangement of this embodiment is such that the return plate 22 which is made of an elastic material such as phosphor bronze or spring steel is disposed between the shoes 19 and the retainer 12, thereby making the spring members 21 unnecessary. By virtue of this arrangement, a reduction in the number of component parts and, hence, a reduction in the causes of noise can be achieved.

Although the foregoing description of the embodiments of the present invention concerns an axial piston pump-motor of the constant displacement type which has a swash plate tilted at a fixed tilt angle, it is to be understood that the present invention may also be applied to a variable displacement type axial piston pump-motor, described in relation to FIG. 1, in which the tilt angle of the swash plate can be varied.

The swash plate type axial piston pump-motor according to the invention provides the effect described below. Since the drive shaft, the retainer, and the cylinder block have an integral structure, the overall structure is simplified and, at the same time, reliability is increased and production costs are lowered. In addition, since the drive shaft, the retainer, and the cylinder block are formed as an integral structure, the likelihood of gaps between these members is eliminated, thus eliminating the risk of any noise being generated even when there is a variation in the load. In addition, since there is no need to make a protrusion, such as an end of the drive shaft, project through the end surface of the cylinder block that is remote from the drive shaft, the end surface can be machined with a greatly increased degree of precision, enabling the limitation of the amount of leakage between the cylinder block and the port plate to a very small amount, and thus enhancing efficiency. Further, since the rear end surface of the cylinder block and the inner surface of the port plate which is in sliding engagement with that rear end surface are formed into matching spherical surfaces, the engagement between these surfaces is enhanced, making the amount of leakage between these surfaces small even if a bending stress is applied to the cylinder block by a certain external force, thereby enabling efficient operation.

Another aspect of the present invention provides the effect of further enhancing the adhesion between the cylinder block and the port plate by providing seal rings which transmit the spring force of elastic members and the pressure acting on the rear surface of the port plate, and by bringing one ends of the seal rings into contact with the rear surface of the port plate.

A further aspect of the present invention provides the effect of achieving a reduction in the total number of component parts and a reduction in the causes of noise by using an elastic member as the return plate, thus eliminating the need for an elastic member interposed between the retainer and the return plate.

What is claimed is:

1. A hydraulic transmission device comprising:

a housing having a closed end portion and an open end portion;

a drive shaft supported within said housing by being inserted through a through hole formed in a substantially central location of said closed end portion of said housing;

a retainer having a spherical outer surface and formed integrally with said drive shaft;

a cylinder block provided within said housing and formed integrally with said drive shaft, said cylinder block having a recess at a substantially central location on the side thereof that is closer to said open end portion of said housing;

a cover member which closes said open end of said housing and has a protruding portion which is in engagement with said recess of said cylinder block through a bearing;

a port plate which is provided between said cover member and said cylinder block and is slidably engageable with the end surface of said cylinder block that is on the side of said open end of said housing;

a plurality of pistons provided in said cylinder block and received in a plurality of cylinders so as to reciprocate therein, said cylinders communicating with fluid suction and discharge hole portions formed in said port plate and said cover member;

a swash plate operationally engaged with said pistons;

shoes secured to said swash plate for receiving front portions of said pistons respectively; and return plates disposed between the respective shoes and said retainer in a springy manner.

2. A hydraulic transmission device according to claim 1, wherein a spring member is interposed between said retainer and each of said return plates.

3. A hydraulic transmission device according to claim 1, wherein said return plates are made of springy metal.

* * * * *